United States Patent [19]

Weatherly

[11] 4,096,874

[45] Jun. 27, 1978

[54] WEATHER SHELTER

[75] Inventor: Mark G. Weatherly, Lynchburg, Va.

[73] Assignee: The Raymond Lee Organization, Inc., New York, N.Y. ; a part interest

[21] Appl. No.: 785,743

[22] Filed: Apr. 8, 1977

[51] Int. Cl.[2] ..... E04F 10/04

[52] U.S. Cl. ..... 135/5 R; 135/71 R; 135/15 PE

[58] Field of Search ..... 135/5 R, 7.1 R, 15 PE; 160/151; 52/83, 86; 297/184

[56] References Cited

U.S. PATENT DOCUMENTS

| | | | |
|---|---|---|---|
| 1,672,927 | 6/1928 | Burk | 135/15 PE |
| 1,950,593 | 3/1934 | Bonnet | 297/248 |
| 2,572,732 | 10/1951 | Keklen et al. | 297/184 |
| 3,052,251 | 9/1962 | De Jean, Jr. | 135/5 R |
| 3,155,427 | 11/1964 | Necessary | 135/5 R X |
| 3,491,781 | 1/1970 | Reese | 135/5 R |
| 3,865,429 | 2/1975 | Barker | 135/5 R |

FOREIGN PATENT DOCUMENTS

| | | | |
|---|---|---|---|
| 1,094,417 | 12/1960 | Germany | 297/184 |

*Primary Examiner*—Werner H. Schroeder
*Assistant Examiner*—Conrad L. Berman
*Attorney, Agent, or Firm*—Daniel Jay Tick

[57] ABSTRACT

A first plurality of like shelter supports lie in equidistantly horizontally spaced parallel vertical planes. Each support consists of a curved elongated unit having a central section resembling the letter C. Each section has a lower end portion which extends vertically below the section and terminates in a bottom end. Each section has an upper end portion which is shorter than the lower end portion and extends upwards and outwards to form a stub. A second plurality of horizontally elongated connector members are provided. There is one less connector member than supports. Each connector member is connected at each end to a stub of a corresponding one of a corresponding pair of next-adjacent supports and extends horizontally therebetween whereby the combination of supports and connector members defines a frame. A flexible waterproof cover is applied over said frame and is secured thereto. The cover has an opening extending vertically from the stubs to the lower end portions and extending horizontally along the entire frame.

3 Claims, 5 Drawing Figures

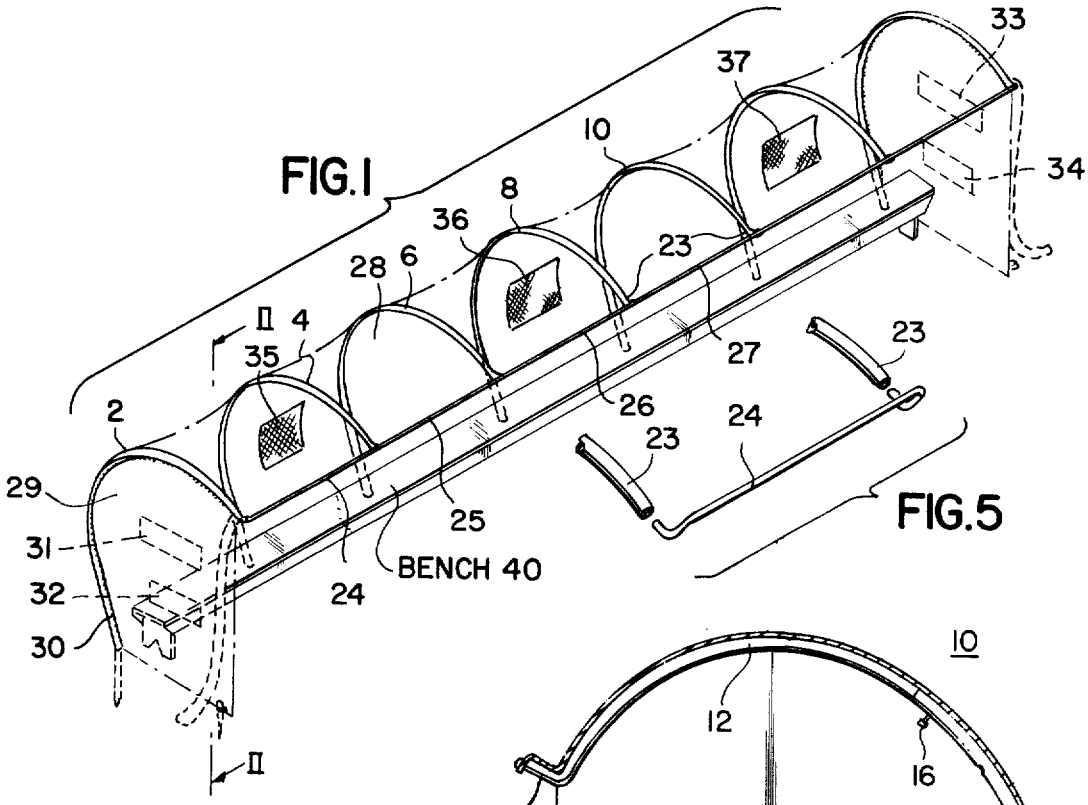
FIG.1
FIG.5
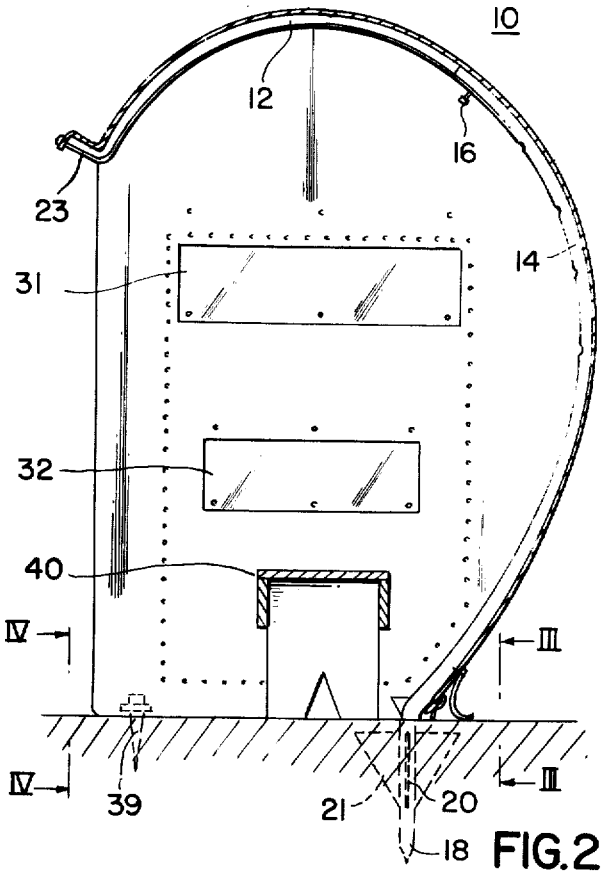
FIG.2
FIG.3
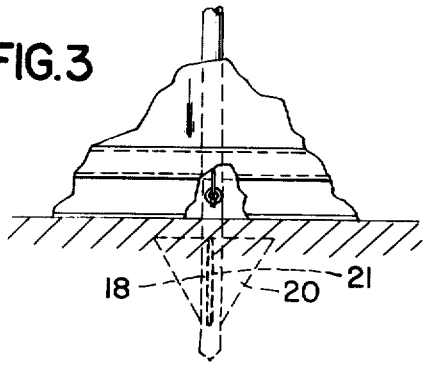
FIG.4
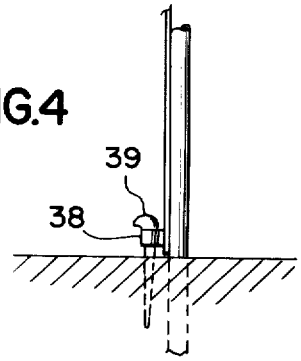

WEATHER SHELTER

BACKGROUND OF THE INVENTION

The present invention relates to a weather shelter.

Portable collapsible shelters are used at football, soccer, hockey, field meets, lacrosse and other games and sporting events and at similar functions to protect players, coaches, and other participants, disposed at the sidelines from rain, snow, wind, and the like. Such shelters are used at any sporting event. Portable collapsible shelters are shown, for example, in U.S. Pat. Nos. 3,042,053, 3,865,429, 3,434,483, and 3,155,427. The collapsible shelter of the present invention differs from those shown in these patents by the use of specially shaped supports which are interconnected by stabilizer members in such manner as to provide a frame or cage which receives a flexible waterproof cover. The frame provides greatly enhanced stability and wind resistance and the entire structure is more durable and less expensive than those disclosed in the aforesaid patents.

In accordance with the principles of the invention, a first plurality of like shelter supports lie in equidistantly horizontally spaced parallel vertical planes. Each support is a curved elongated unit having a central section resembling the letter C. Each section has a lower end portion which extends vertically below the section and terminates in a bottom pointed end, and has an upper end portion which is shorter than the lower end portion and extends upwards and outwards to form a stub. A second plurality of horizontally elongated members is provided in a number one less than the number of supports. Each member is connected at each end to a stub of a corresponding one of a corresponding pair of next-adjacent supports and extends horizontally therebetween. The combination of supports and connector members defines a frame. A flexible waterproof cover is applied over the frame and is secured thereto. The cover has an opening extending vertically from the stubs to the lower end portions and extending horizontally along the entire frame.

The entire structure is rapidly and easily assembled and disassembled. The members act as stabilizers and assist in defining rain gutters. The lower end portions are removably inserted into the ground to hold the shelter in place. Benches, or the like, may be removably disposed within the frame.

BRIEF DESCRIPTION OF THE DRAWINGS

In order that the invention may be readily carried into effect, it will now be described with reference to the accompanying drawings, wherein:

FIG. 1 is a perspective view of an embodiment of the weather shelter of the invention;

FIG. 2 is a cross-sectional view, on an enlarged scale, taken along the lines II—II, of FIG. 1;

FIG. 3 is a view, taken along the lines III—III, of FIG. 2;

FIG. 4 is a view, taken along the lines IV—IV, of FIG. 2; and

FIG. 5 is a perspective exploded view, on an enlarged scale, of part of the weather shelter of FIG. 1.

DETAILED DESCRIPTION OF THE INVENTION

As shown in FIGS. 1 to 4, a plurality of like shelter supports 2, 4, 6, 8, 10, and so on, lie in equidistantly horizontally spaced parallel vertical planes. Each supports 2, 4, 6, 8, 10, and so on, consists of a curved elongated unit having a central section in the general shape of a C formed by outer and inner hollow aluminum tubes 12 and 14, as shown in FIG. 2. The tube 12 is slidably and adjustably positioned within the tube 14 and the adjusted overall length is established by tightening thumbscrews 16, or the like (FIG. 2). The lower end of the tube 14 of each support forms a vertical straight portion 18 having a downward pointed end (FIGS. 2 and 3).

Triangular plates 20 and 21 may be secured to opposite sides of the portion 18 extending at right angles to each other (FIGS. 2 and 3). The plate 20 extends perpendicularly to the plane of the unit. The plates 20 and 21 stabilize the lower part of the unit when the portion 18 is removably inserted in the ground.

The upper end of the tube 12 is formed in a short upwardly and outwardly extending stub 23 (FIGS. 1, 2 and 5).

A plurality of like horizontally elongated connector members 24, 25, 26, 27, and so on, are provided in a number one less than the number of shelter supports 2, 4, 6, 8, 10, and so on (FIG. 1). Each of the connector members 24 to 27, and so on, has spaced opposite ends and is inwardly turned at each end. Each of the connector members 24 to 27, and so on, is connected at each end to the open end of a corresponding one of the stubs, of a corresponding pair of next-adjacent supports and extends horizontally therebetween. The connector members 24 to 27, and so on, are coupled to each other, by any suitable device, and function to connect and stabilize the upper portion of the structure.

A durable flexible waterproof cover 28 (FIG. 1) overlies the frame formed by the supports and connector members. The ends 29 of the cover 28 are secured by zippers 30 (FIG. 1) and may have ventilators 31, 32, 33 and 34 (FIGS. 1 and 2). The ventilators 31 to 34 may be inexpensive mesh or screened cutouts covered by polyethylene flaps or by panels which are removably affixed by zippers, snap fasteners, or the like. The flaps are held shut, when desired, by a fastening device, such as, for example, VELCRO, at each corner.

The waterproof cover 28 preferably comprises a 10 mil gauge polyethylene and preferably has three mesh or screened cutout ventilators 35, 36 and 37 therein, as shown in FIG. 1.

The portion of the cover 28 overlying the stubs defines a rain gutter. The cover 28 is kept in place by any suitable devices on the frame to facilitate water drainage. A suitable device may comprise snap fasteners, for example. The bottom portions of the cover 28 have loops such as, for example, the loop 38, shown in FIG. 4, affixed thereto for removably accommodating stakes such as, for example, the stake 39, shown in FIGS. 2 and 4. The loops and stakes may also be used to hold the ends 29 in place.

The cover 28 has a front opening extending vertically between stubs and portions 18 and extending horizontally along the frame as shown. Benches 40, or the like, may be disposed inside the shelter for use as described (FIGS. 1 and 2).

The weather shelter of the invention is erected by placing the supports 2, 4, 6, 8, 10, and so on, in the ground at suitable intervals. The connector members 24, 25, 26, 27, and so on, are then installed. The main cover 28 is secured in place. Then, the end covers 29 are secured in place.

The unique construction of the weather shelter of the invention permits either end of the cover 28, or either end cover 29, to be unzipped or unsnapped, thereby permitting two or more units to be joined to each other in next-adjacent relation with free access between the units. Each end cover 29 functions as a door and may be unsnapped or unzipped to provide access to the unit or exit from the unit or to a next-adjacent unit.

The weather shelter of the invention has a minimum capacity of 22 people. The supports 2, 4, 6, 8, 10, and so on, have a predetermined degree of cuvature and extend to a predetermined height above a supporting surface.

While the invention has been described by means of a specific example and in a specific embodiment, I do not wish to be limited thereto, for obvious modifications will occur to those skilled in the art without departing from the spirit and scope of the invention.

I claim:

1. A disassembleable and portable weather shelter, comprising a plurality of like shelter supports equidistantly horizontally spaced in parallel vertical planes, each support consisting of a curved elongated unit having a central section resembling the letter C, said section having a lower end portion which extends vertically below said section and terminating in a bottom pointed end, each section having an upper end portion shorter than the lower end portion and extending upwards and outwards to form a stub, each of said supports including two curved hollow tubes, one slidable and adjustably positioned within the other;

a plurality of elongated connector members, the number of connector members being one less than the number of supports, each of said connector members having spaced opposite ends and being connected at each end to a stub of a corresponding one of a corresponding pair of next-adjacent supports and extending horizontally therebetween, the combination of supports and connector members defining a frame; and a flexible waterproof cover applied over the frame and secured thereto, said cover having an opening extending vertically from the stubs to the lower end portions and extending horizontally along the entire frame and including end parts extending next-adjacent the supports at the opposite ends of said plurality of supports, each of the end parts having screened cutouts formed therein and flaps for selectively covering said cutouts.

2. A weather shelter as claimed in claim 1, wherein the lower end portion of each of said supports has oppositely disposed triangularly shaped plates extending at right angles to each other, one of said plates being perpendicular to the plane of the unit.

3. A weather shelter as claimed in claim 1, wherein the stub of each of the supports has an open end and the connector members have inwardly turned ends inserted into the open end of the stubs.

* * * * *